US006912957B2

(12) United States Patent
Aoyama et al.

(10) Patent No.: US 6,912,957 B2
(45) Date of Patent: Jul. 5, 2005

(54) PRINTING PRESS WITH A TEMPERATURE CONTROL UNIT FOR A PLATE CYLINDER

(75) Inventors: Hideo Aoyama, Fuchu (JP); Hidekatsu Baba, Tokyo (JP)

(73) Assignee: Ryobi, Ltd. (JP)

( * ) Notice: Subject to any disclaimer, the term of this patent is extended or adjusted under 35 U.S.C. 154(b) by 0 days.

(21) Appl. No.: 10/755,425

(22) Filed: Jan. 12, 2004

(65) Prior Publication Data

US 2004/0139875 A1 Jul. 22, 2004

(30) Foreign Application Priority Data

Jan. 15, 2003 (JP) ..... 2003-007084

(51) Int. Cl.[7] ..... B41F 23/00
(52) U.S. Cl. ..... 101/487; 101/216
(58) Field of Search ..... 101/487, 488, 101/216, 219, 212

(56) References Cited

U.S. PATENT DOCUMENTS 5,585,904 A * 12/1996 Yamamoto et al. ..... 399/307
6,116,158 A * 9/2000 DeMoore et al. ..... 101/177
6,209,456 B1 * 4/2001 Murray et al. ..... 101/487
6,352,027 B1 * 3/2002 Wadlinger ..... 101/216
6,435,086 B1 * 8/2002 Rendleman et al. ..... 101/177

FOREIGN PATENT DOCUMENTS

JP 06-143395 6/1994

* cited by examiner

*Primary Examiner*—Anthony H. Nguyen
(74) *Attorney, Agent, or Firm*—Perkins Coie LLP

(57) ABSTRACT

A printing press is provided with a temperature control unit for controlling the temperature of a surface of a printing plate mounted on a plate cylinder by feeding air onto the plate cylinder. A plate-replacement space is provided in a certain region around the plate cylinder for replacement of a printing plate mounted on the plate cylinder with a new one introduced from the outside of the printing press. The temperature control unit is designed to be selectively shifted between a temperature control mode and a space opening mode, in which the temperature control mode enables air to be fed through the plate-replacement space onto the plate cylinder, and the space opening mode makes the plate-replacement space open to the outside of the printing press so that the replacement of a printing plate can be done.

3 Claims, 10 Drawing Sheets

PRINTING PRESS WITH A TEMPERATURE CONTROL UNIT FOR A PLATE CYLINDER

CROSS REFERENCE TO RELATED APPLICATION

This application claims priority from Japanese Patent Application No. 2003-007084, which is incorporated herein by reference.

BACKGROUND OF THE INVENTION

1. Field of the Invention

The present invention relates to a printing press with a temperature control unit for a plate cylinder and more particularly for a surface of each printing plate mounted on the plate cylinder.

2. Related Art

A printing press constructed having a plate cylinder on which printing plates are mounted is equipped with an ink unit for supplying ink onto each printing plate. The ink unit transfers ink from an ink fountain through a number of ink rollers, and finally onto the surface of each printing plate mounted on the plate cylinder through an ink-applying roller (a foam roller) of these ink rollers. As used throughout the description, by a surface of the plate cylinder or a plate surface is meant the circumference of the plate cylinder with a single or plural printing plates mounted thereon.

According to the above ink transferring operation, the viscosity of ink is influenced by the temperature. That is, when the plate surface has a relatively low temperature, ink has excessively high viscosity and hence is hard to transfer such as on an edge portion of an image to be printed. On the other hand, when the plate surface has a relatively high temperature, ink has excessively low viscosity and hence may cause blur such as in minute portions of an image printed on sheets of paper.

Thus, the amount of ink applied from the ink-applying roller onto the plate surface is greatly influenced by the temperature of the plate surface. In this regard, where the temperature control is made by a temperature control unit equipped on the ink-roller side for controlling the temperature of ink on the ink-roller side, this unit is still hard to allow ink transferred from the ink-applying roller onto the plate surface to be maintained in a good condition and hence hard to obtain a good quality of printing for the plate surface having a temperature out of a certain range. In order to address this problem, another approach was made as disclosed in Japanese Patent Laid-open No. HEI-8-1918.

In the above-cited reference, a temperature control unit has an air-feeding means having an air outlet fixed in position around the plate cylinder, through which air is fed onto the plate surface. This fixed arrangement of the air outlet causes a problem that the printing press tends to increase in size particularly for a portion around the plate cylinder. Specifically, the problem is that only a limited space is left for such an air outlet due to the necessity to locate various units and parts such as an ink unit, a blanket cylinder and the like around the plate cylinder. In some cases, the plate cylinder must be increased in size for accommodating the air outlet in addition to those units and cylinders.

An air outlet may be located away from the plate cylinder than the ink roller is, but an airflow from the air outlet may be blocked by the ink roller and therefore is hard to reach the plate surface, resulting in difficulty to precisely control the temperature of the plate surface.

In consideration of the above, it is an object of the present invention to provide a printing press with a temperature control unit for the plate surface of a plate cylinder that is capable of efficiently utilizing the space around the plate cylinder, while providing precise control of the temperature of the plate surface in easy manner.

SUMMARY OF THE INVENTION

According to the present invention, there is provided a printing press with a temperature control unit for controlling the temperature of a surface of a printing plate mounted on a plate cylinder by feeding air onto the plate cylinder, in which a plate-replacement space is provided in a certain region around the plate cylinder for replacement of a printing plate mounted on the plate cylinder with a new one introduced from the outside of the printing press. The temperature control unit is designed to be selectively shifted between a temperature control mode and a space opening mode, in which the temperature control mode enables air to be fed through the plate-replacement space onto the plate cylinder, and the space opening mode makes the plate-replacement space open to the outside of the printing press so that the replacement of a printing plate can be done.

With the thus arranged printing press, the temperature control unit is held in the temperature control mode when the temperature of the plate surface is to be controlled. For this control, air is fed onto the plate cylinder through the space utilized as a printing plate-replacement space. That is, this arrangement can allow air to be fed onto the plate cylinder by efficiently utilizing the printing plate-replacement space. As a result, it is not necessary to additionally provide an air feeding space around the plate cylinder. In addition, various constitutional members or parts provided around the plate cylinder are unlikely to block airflow, since air is fed by utilizing the printing plate-replacement space. As a result, air is securely fed onto the plate cylinder so that the temperature of the plate surface can be precisely controlled.

Preferably, in the above printing press, a lid capable of being opened and closed is provided over the plate-replacement space so that a printing plate mounted on the plate cylinder can be replaced with a new one through the plate-replacement space during the lid is opened, and the temperature control unit has an air outlet formed integral with an inner side of the lid. The air outlet is designed to be selectively shifted between a temperature control position enabling air to be fed through the plate-replacement space onto the plate cylinder and a retracted position making the plate-replacement space open to the outside of the printing press upon opening and closing actions of the lid.

With the above arrangement, the air outlet is automatically shifted to the temperature control position upon closing the lid, while being automatically shifted to the retracted position upon opening the lid so that the temperature control unit is automatically brought into the opened state. Thus, with the arrangement having the air outlet integrally formed with the inner side of the lid, the air outlet can be easily shifted to a target position.

Preferably, in the printing press with a lid capable of being opened and closed provided over the plate-replacement space so that a printing place mounted on the plate cylinder can be replaced with a new one through the plate-replacement space during the lid is opened, the lid has a passing hole, through which an air outlet passes into and out of the plate-replacement space, thereby allowing the air outlet to be held at a temperature control position on the inner side of the lid when in the temperature control mode of the temperature control unit, and to be held at a retracted position on the outer side of the lid when in the space opening mode of the temperature control unit. The air outlet is linearly moved toward and away from the plate cylinder at least a distance from the temperature control position to a position at which the air outlet having passed through the passing hole reaches the outside of the passing hole in the entire travel distance between the temperature control position and the retracted position.

With the above arrangement, the air outlet is linearly moved toward and away from the plate cylinder at least a distance from the temperature control position to a point at which the air outlet having passed through the passing hole reaches the outside of the passing hole in the entire travel distance between the temperature control position and the retracted position. As a result, even if the printing plate-replacement space is relatively small, the air outlet can be easily moved closer to the plate cylinder so that the temperature control for the plate surface can be more securely made by the temperature control unit held in the temperature control mode.

Preferably, in the above printing press, the plate-replacement space and the lid are located above the plate cylinder. The air outlet takes a first motion and a second motion during the air outlet moves between the temperature adjustment position and the retracted position. The first motion is a vertical linear motion. This motion is taken between a transit position above the lid and the temperature control position. The second motion is a pivotal motion in a horizontal plane around a vertical axis. This motion is taken between the transit position and the retracted position. In this arrangement, the printing press includes two plate cylinders located parallel to each other in a horizontal plane and the air outlet is provided for each of the plate cylinders. The air outlets of the plate cylinders are pivotally moved in a double-door like manner in the second motion.

With the above arrangement having two plate cylinders, although the air outlets of the plate cylinders are positioned above the lid when in the opened state, the air outlets, which have been pivotally moved in a double-door like manner closer to each other and held at the retracted position, are unlikely to interfere a plate-replacement work.

According to another aspect of the present invention, there is provided a printing press with a temperature control unit for controlling the temperature of a surface of a printing plate mounted on a plate cylinder by feeding air onto the plate cylinder, in which the plate cylinder is designed so that plural printing plates are mounted thereon. The printing press includes an image-forming unit disposed in proximity to the plate cylinder so as to form an image on each of the plural printing plates. A plate-replacement space is provided in a certain region around the plate cylinder for replacement of a printing plate mounted on the plate cylinder with a new one introduced from the outside of the printing press. The temperature control unit is designed to be selectively shifted between a temperature control mode and a space opening mode. The temperature control mode enables air to be fed through the plate-replacement space onto the plate cylinder. The space opening mode makes the plate-replacement space open to the outside of the printing press so that the replacement of a printing plate can be done.

Generally, when plural printing plates are mounted on a plate cylinder, the same number of ink units are correspondingly disposed for these printing plates for supplying ink thereon. When an image-forming unit is to be provided around the plate cylinder in addition to the ink units, it is very difficult to secure a space exclusively used for airflow onto the plate cylinder therearound. However, according to the printing press of the present invention, it is not necessary to separately provide a space exclusively used for airflow onto the printing plate, since the feeding of air onto the plate cylinder is achieved by efficiently utilizing the plate-replacement space. In addition, this utilization of the plate-replacement space makes it possible to prevent various units and parts such as ink units and an image-forming unit located around the plate cylinder from blocking airflow onto the plate cylinder so that air can be securely fed onto the plate cylinder, thus achieving the temperature control of the plate surface in precise manner.

BRIEF DESCRIPTION OF THE DRAWINGS

The above, and other objects, features and advantages of the present invention will become apparent from the detailed description thereof in conjunction with the accompanying drawings wherein.

DESCRIPTION OF THE PREFERRED EMBODIMENTS

An embodiment of the printing press with the temperature control unit for the plate surface according to the present invention will be herein described with reference to FIGS. 1 to 4. The description will be first made for the printing press that includes a plate-surface temperature control device A for controlling the temperature of the plate surface by feeding air onto a plate cylinder 1.

Figure 1:
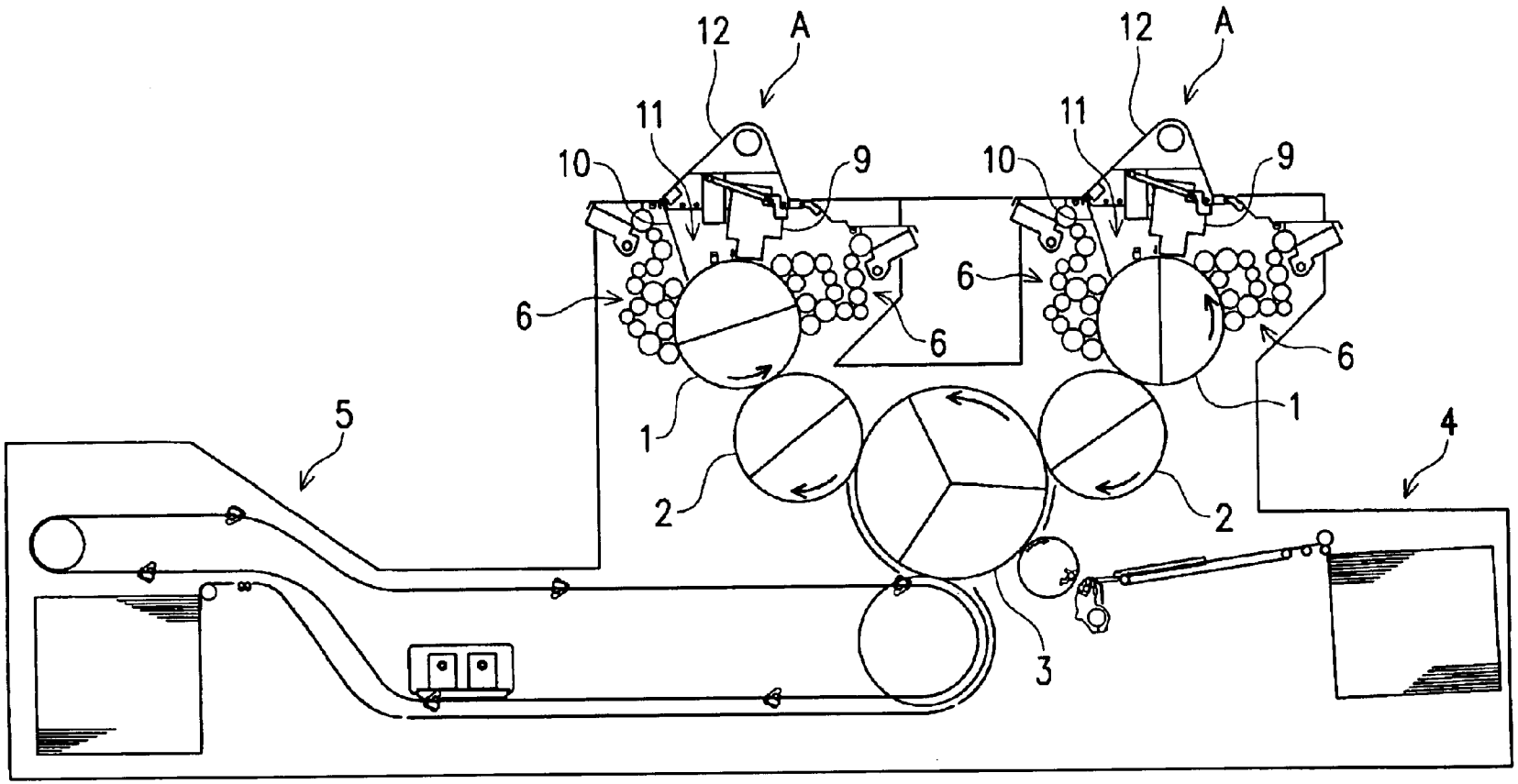
FIG. 1 is a front elevational view of a printing press with a temperature control unit for the plate surface according to one embodiment of the present invention.

The printing press of this embodiment is a four color printing press that has four plate surfaces in total. Specifically, two pairs, each pair including the plate cylinder 1 and a blanket cylinder 2, are provided for an impression cylinder 3 according to the cylinder arrangement of the printing press of this embodiment. The impression cylinder 3 is a triple-diameter cylinder, while each of the plate cylinder 1 and the blanket cylinder 2 is a double-diameter cylinder that has two plate surfaces. Sheets of paper fed from a sheet-feeding unit 4 and placed on the impression cylinder 3 each are printed in two colors upon one rotation of the impression cylinder 3 and then printed in residual two colors upon a subsequent rotation of the impression cylinder 3 so that the sheets are each printed in a total of four colors during every time the impression cylinder 3 rotates twice. Then, the sheets are transferred from the impression cylinder 3 to a sheet-discharging unit 5. The two plate cylinders 1 are disposed parallel to each other with a distance in a horizontal plane, as illustrated in FIG. 1.

Figure 2:
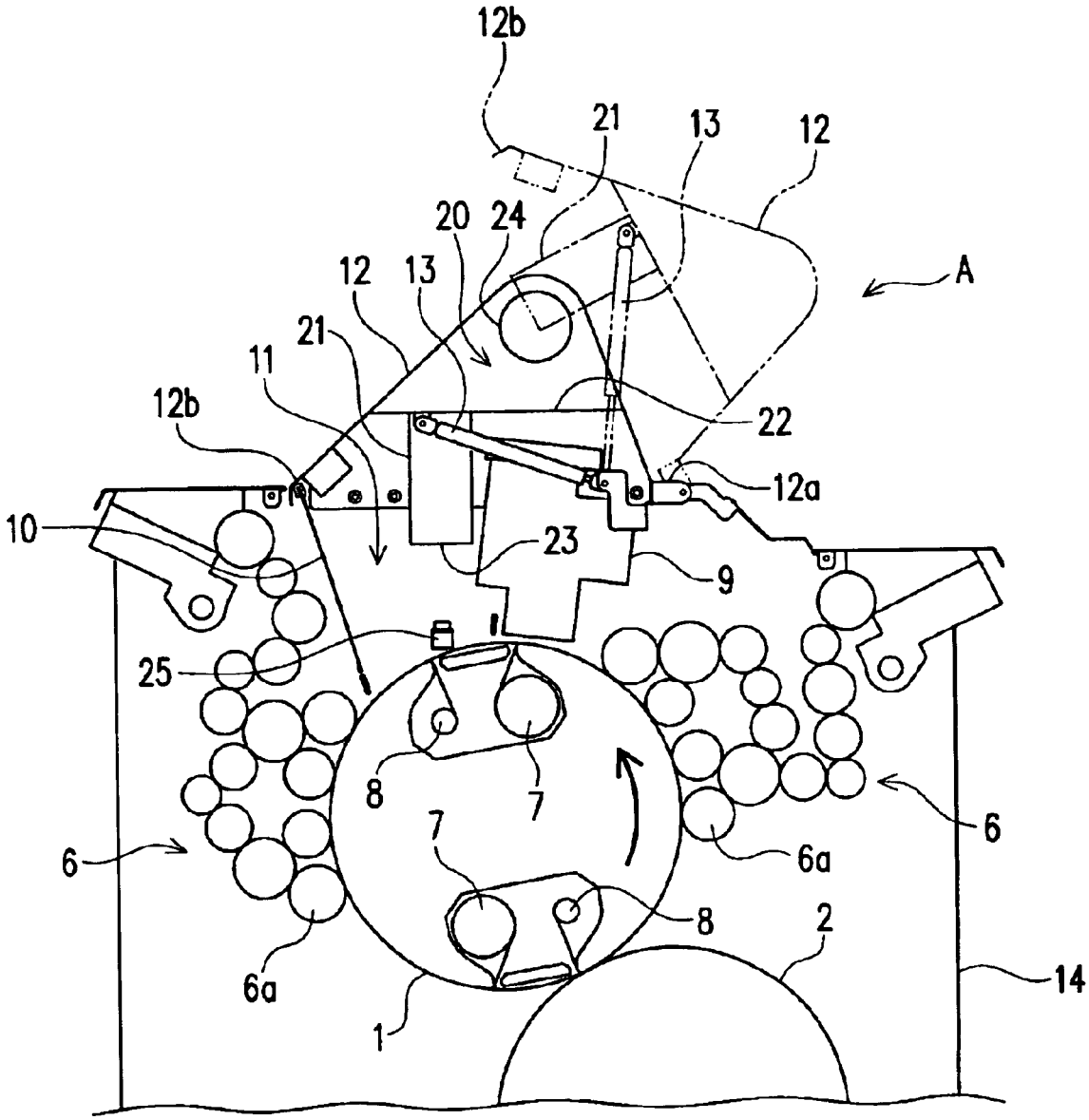
FIG. 2 is a front elevational view of the plate cylinder and its proximity in the printing press.

The plate cylinders 1 each are designed to allow two printing plates to be mounted thereon. Accordingly, two ink units 6 are disposed around the plate cylinder 1 so as to each supply ink onto a corresponding printing plate. As illustrated in FIG. 2, these printing plates are respectively fed onto the circumference of the plate cylinder 1 from feed reels 7 so that an image-forming unit 9 forms an image on each of the printing plates fed onto the circumference of the plate cylinder 1. The printing plates after use are wound around take-up reels 8 from the circumference of the plate cylinder 1 and unused or new printing plates are respectively fed onto the circumference of the plate cylinder 1 from the feed reels 7. The thus arranged printing press of this embodiment is a so-called digital printing press that is equipped with the image-forming unit 9 for forming an image on each printing plate mounted on the plate cylinder 1, in which the image-forming unit 9 forms an image on each printing plate on the basis of an input image data. The image-forming unit 9 has a lengthwise axis extending parallel to the axis of the plate cylinder 1 and a length substantially equal to the width of the printing plate. The image-forming unit 9 is located between the two ink units 6 and above the plate cylinder 1. The ink units 6 each include plural ink-applying rollers 6*a* (four in this embodiment) for transferring ink onto the printing plates, and are located with a distance to each other around the circumference of the plate cylinder 1. Although no illustration is given, this printing press of this embodiment is provided with a unit or device for controlling the temperature of the ink rollers. A plate-cleaning unit may be disposed between a group of the ink units 6 and the blanket cylinder 2 for cleaning the printing plates.

A shield plate 10 is disposed between the image-forming unit 9 and the ink unit 6 located on the downstream side of the plate cylinder 1 with respect to the rotational direction thereof, and extends substantially throughout the entire length of the plate cylinder 1. A space is provided between the shield plate 10 and the image-forming unit 9, through which a printing plate is replaced with a new one. A lower end of the shield plate 10 and a lower end of the image-forming unit 9 are both located in proximity to the plate cylinder 1.

A lid 12 is provided on the outside of the plate-replacement space 11 so as to be pivotally moved up and down around a first end 12*a* thereof between an open position and a closed position. The lid 12 is also designed to cover over the image-forming unit 9. At the closed position, a second end 12*b* opposite to the pivotal axis is positioned on an upper end of the shield plate 10. A gas damper 13 is provided for smooth opening and closing operations of the lid 12.

Figure 3:
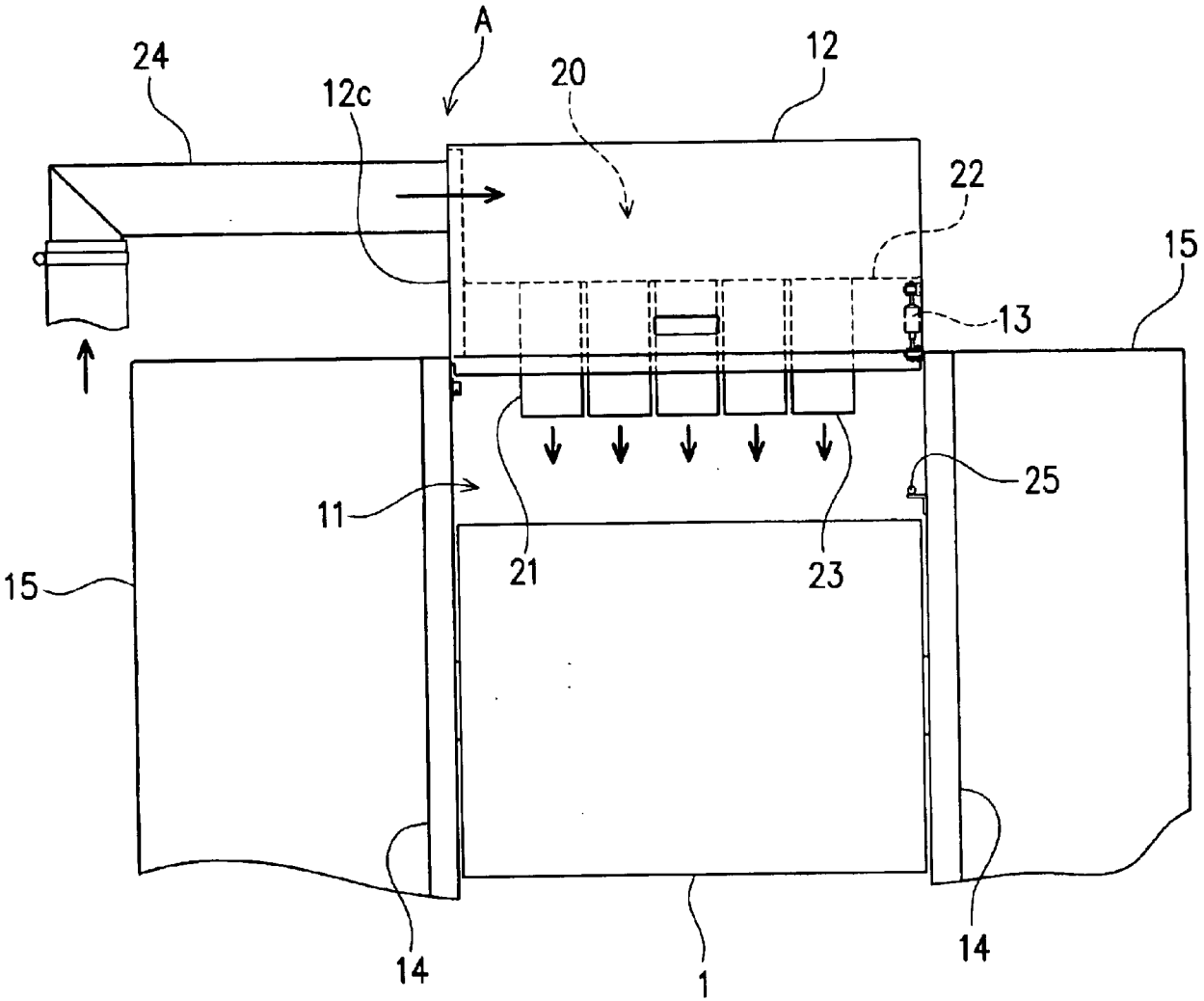
FIG. 3 is a side elevational view of an essential portion of the printing press.
Figure 4:
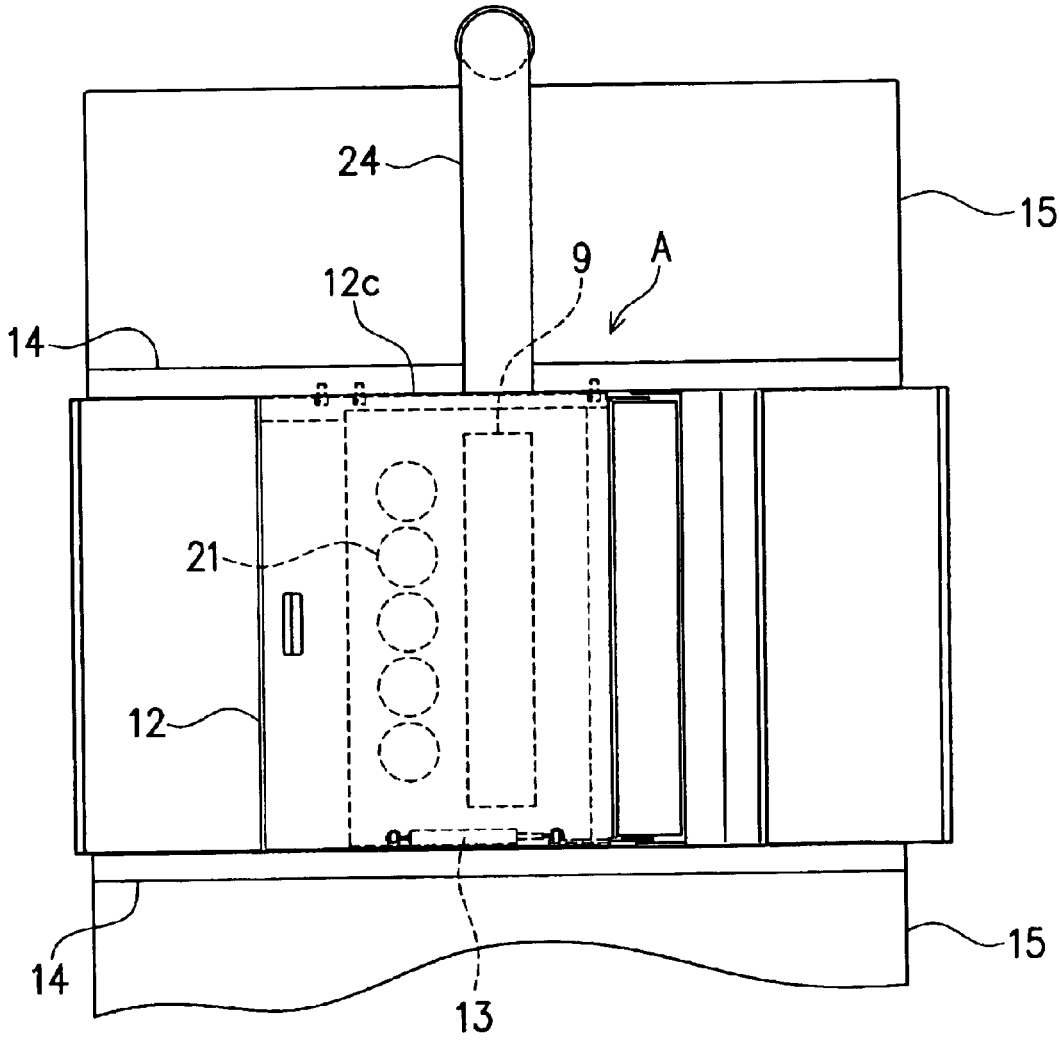
FIG. 4 is a top plan view of the essential portion of the printing press.

In FIGS. 2 to 4, a reference numeral 14 represents a pair of frames located in a fore and aft direction of the printing press so as to rotatably support the respective cylinders such as the plate cylinder 1. Upper ends of the frames 14 reach the lid 12 held in at closed position. Accordingly, the plate-replacement space 11 is substantially closed by the shield plate 10, the image-forming unit 9, the plate cylinder 1, the lid 12 and the front and rear frames 14 during the lid 12 is held at the closed position. A cover 15 is provided outside of the front and rear frames 14 so as to cover associated parts and members such as various gears.

Figure 5:
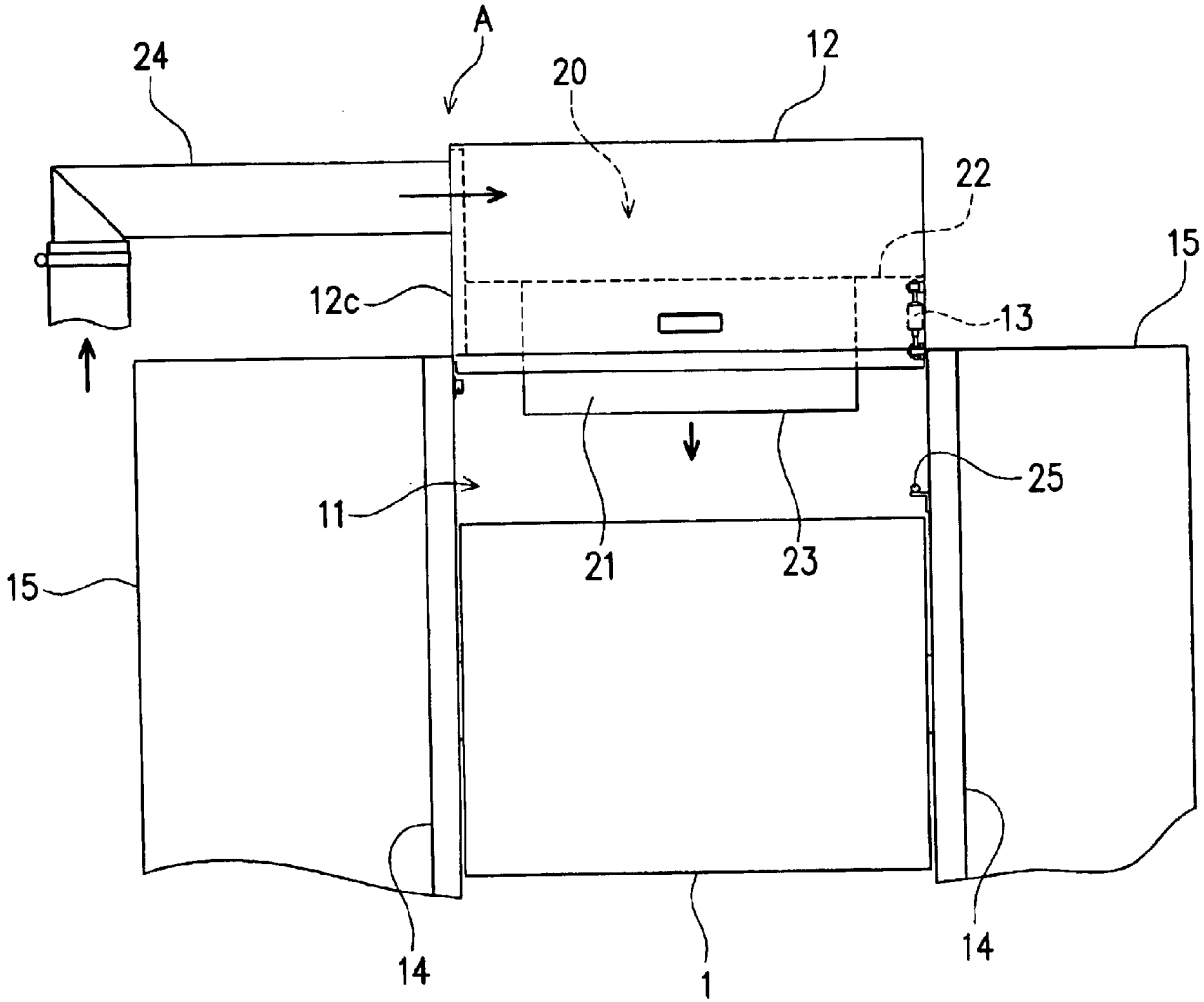
FIG. 5 is a side elevational view of an essential portion of the printing press with the temperature control unit according to another embodiment of the present invention.
Figure 6:
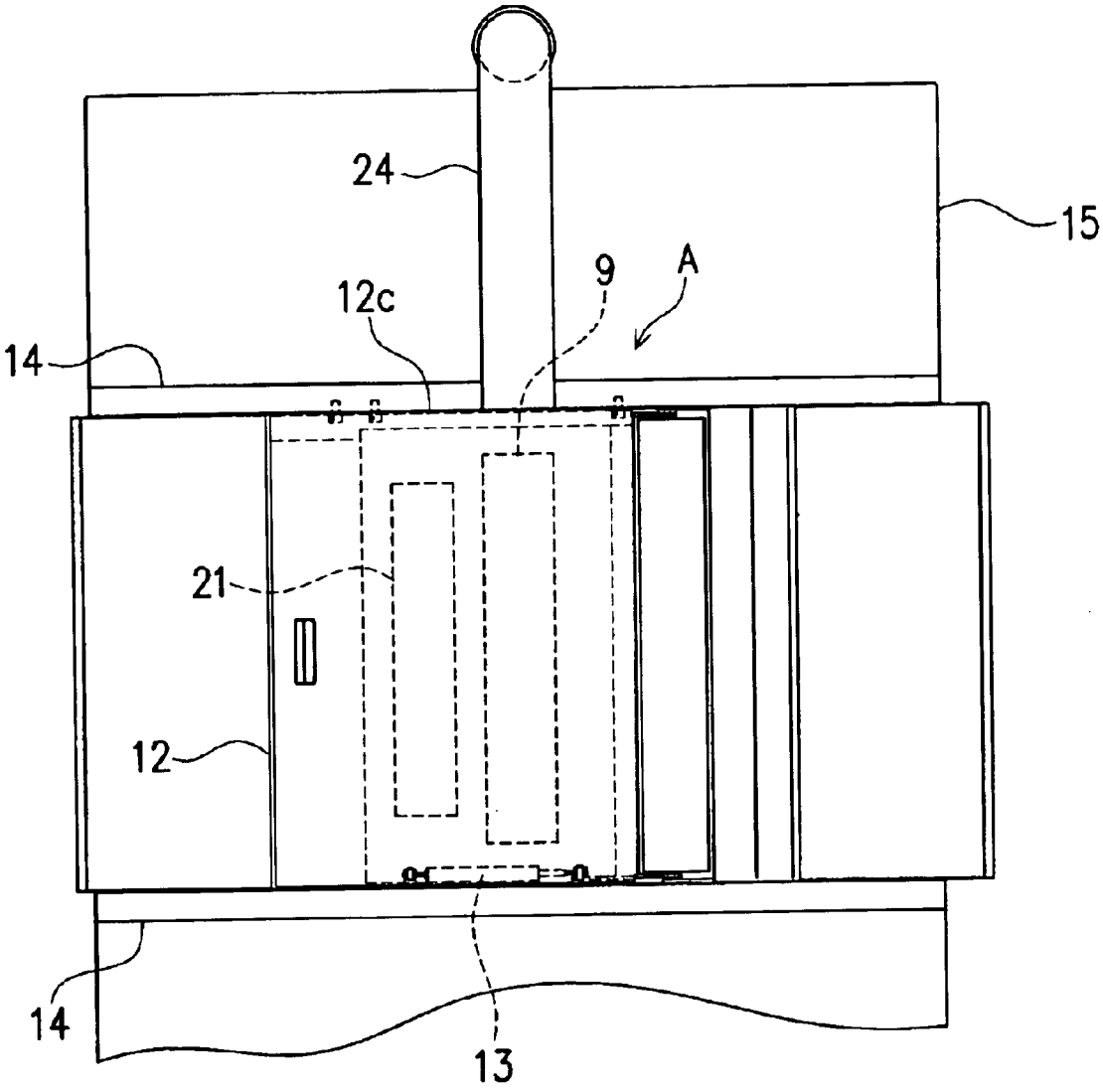
FIG. 6 is a top plan view of an essential portion of the printing press of FIG. 5.

Now, the detailed description will be made for the lid 12. The lid 12 has a reversed U-shape starting from the first end 12*a* as the pivotal axis to the second end 12*b* defining an opening. In an upper portion of the inside of the lid 12 is provided an air reservoir 20 having a substantially triangular cross section, into which air is fed from an air-feeding source (not shown) through an air conduit 24 and a rear wall 12*c* of the lid 12. Air fed from the air-feeding source is once reserved in this reservoir 20 before fed onto the plate surface so that a substantially constant amount of airflow is blown through each of nozzles 21. The nozzles 21 each extend downwards from a floor 22 of the reservoir 20, having a substantially vertical axis with a lower end forming an air outlet 23. The nozzles 21 are located between the image-forming unit 9 and the shield plate 10, as illustrated in FIG. 2. That is, the nozzles 21 are located in the plate-replacement space 11 and air is fed through the air outlets 23 of the lower ends of the nozzles 21 substantially in a vertically downward direction onto the plate cylinder 1. The plural nozzles 21 (five nozzles in total in this embodiment), each having substantially a hollow cylinder shape, are spaced apart from each other in parallel relationship with the axial direction of the plate cylinder 1, as illustrated in FIGS. 3 and 4. It is to be noted that the shape and number of nozzles 21 are not limited, and therefore it is possible to employ, for example, a single nozzle formed into a hollow rectangular column with a certain length in the axial direction of the plate cylinder 1, in place of plural nozzles, as illustrated in FIGS. 5 and 6.

Referring back to FIGS. 2 to 4, a temperature sensor 25 is provided within the plate-replacement space 11. The temperature of air fed from the air-feeding source is controlled on the basis of the output of the sensor 25. The sensor 25 is fixed inside of the front frame 14 and located directly under the nozzles 21 when viewed in the axial direction of the plate cylinder 1, as illustrated in FIG. 2. An appropriate temperature of ink transferred onto the plate surface is such as in the range of 25° C. to 30° C. Therefore, the temperature of air fed is controlled to allow the temperature of the plate surface and hence the temperature of the plate-replacement space 11 to be in that range. A humidity sensor may be provided to control the humidity in addition to the temperature sensor 25 for simultaneous control of the humidity of air. In this case, the humidity is controlled to be in the range of 50% to 60%.

According to the printing press with the thus arranged temperature control unit for the plate surface, upon opening and closing of the lid 12, the plate-surface temperature control device A can be shifted between a temperature control position enabling air to be fed from the plate-replacement space 11, and an opening position enabling the plate-replacement space 11 to be opened to the outside for enabling replacement of a printing plate. Specifically, the air outlets 23 are brought into a temperature control position within the plate-replacement space 11 upon closing the lid 12. Then, by, for example, pushing a switch (not shown), the plate-surface temperature control device A is activated so that air, which has been heated or cooled according to the temperature detected by the sensor 25, is fed from the air-feeding source. That is, when the temperature as detected is relatively low, heated air is fed. On the other hand, the temperature as detected is relatively high, cooled air is fed. In a case where the humidity control is carried out, humid air or dry air is fed according to the humidity as detected by the humidity sensor.

With the above arrangement, air is fed onto the plate cylinder 1 by utilizing the plate-replacement space 11 under such a temperature-controlled state without any obstacle against airflow from the air outlets 23 to the plate cylinder 1 so that air can securely reach the plate surface and precisely control the temperature of the plate surface. In addition, the arrangement allowing air to be once reserved in the air reservoir 20 formed inside of the lid 12 and then fed into the nozzles 21 can limit fluctuations in the amount or temperature of airflow from each of the plural nozzles 21 or differences in these values between the nozzles 21. It is also not necessary to separately provide a space exclusively used for accommodating the air outlets 23 around the plate cylinder 1, since air is fed by utilizing the plate-replacement space 11. The effect of omitting the space for the air outlets 23 is remarkable in the arrangement where the plural ink units 6 and the image-forming unit 9 are to be disposed around the plate cylinder 1, and also in the arrangement where a plate cleaning unit (not shown) is to be further provided.

On the other hand, when the lid 12 is opened, the nozzles 21 are pivotally moved integral with the lid 12 into a retracted position as illustrated in chain double-dashed line in FIG. 2. That is, the plate-surface temperature control device A is brought into the opening position so that the plate-replacement space 11 is opened to the outside above the plate cylinder 1, through which the printing plate replacement work can be done.

In this embodiment, air is fed from the air-feeding source into the nozzles 21 and then blown out through the air outlets 23 formed at the lower ends of the nozzles 21. In place of this heated or cooled air blowing arrangement, it is also possible to employ an electronic cooling-and-heating unit for cooling and heating air fed from the air-feeding source.

Figure 7:
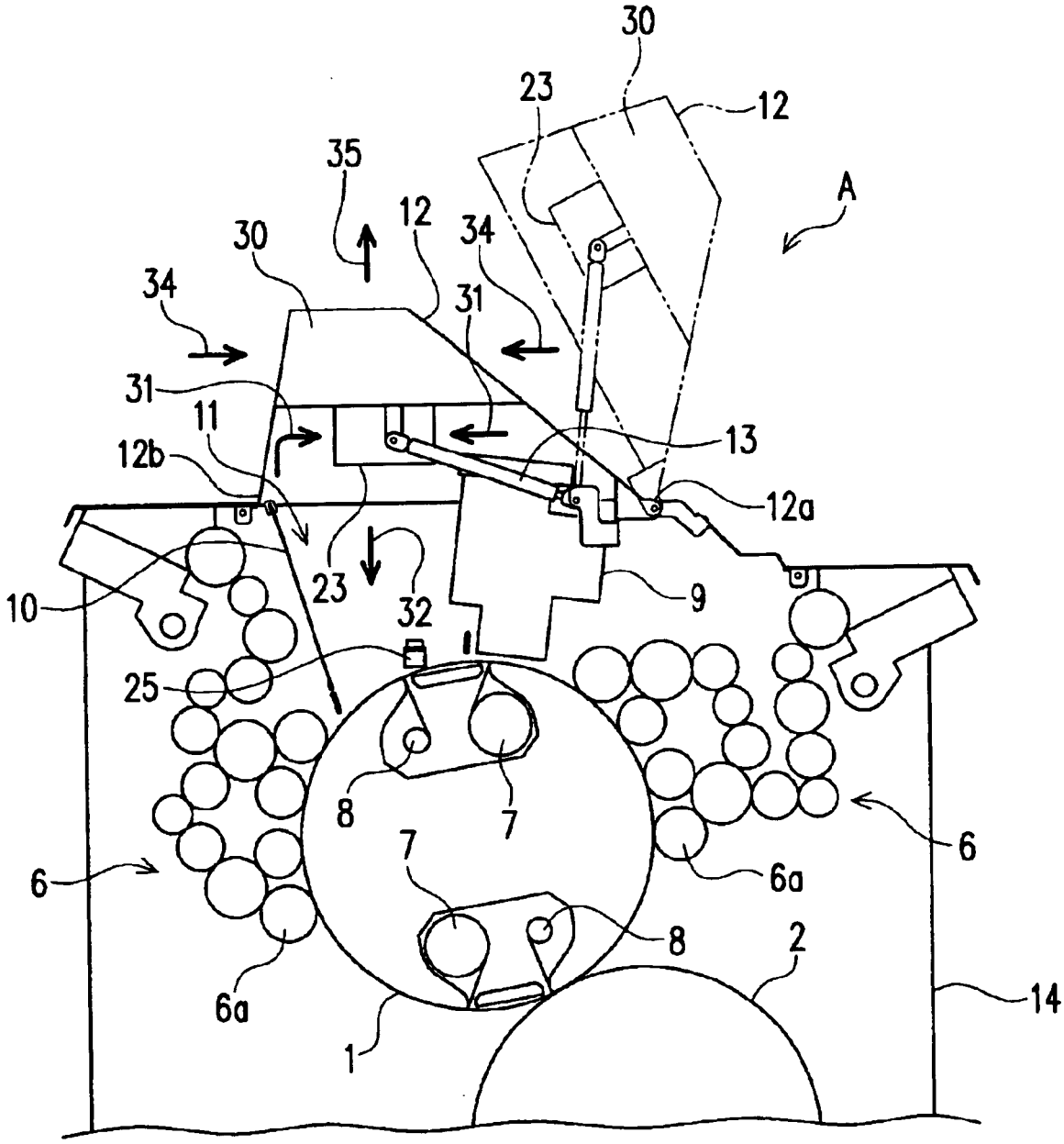
FIG. 7 is a front elevational view of an essential portion of the printing press with the temperature control unit according to still another embodiment of the present invention.
Figure 8:
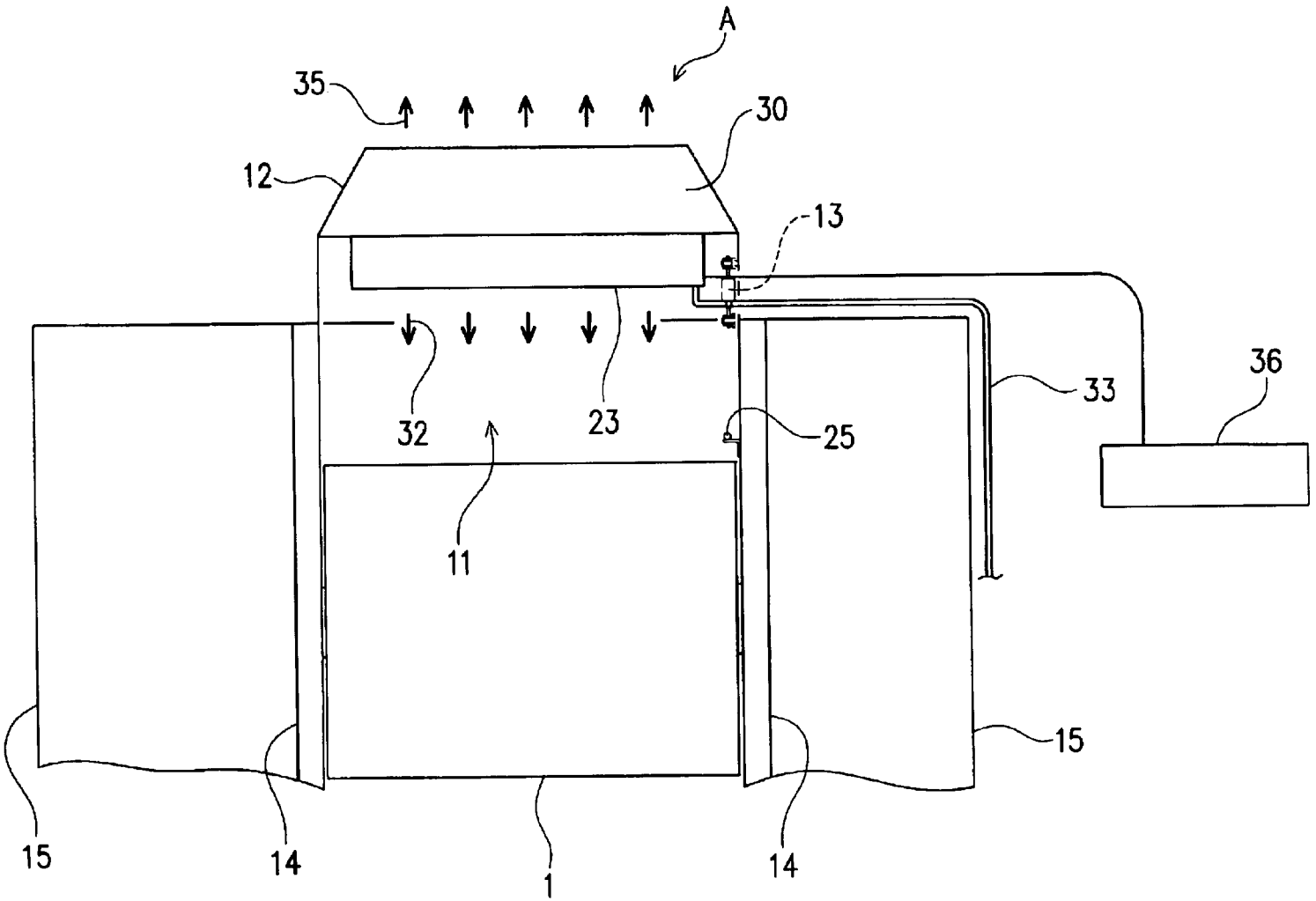
FIG. 8 is a side elevational view of the essential portion of the printing press of FIG. 7.

Now, the description will be made for an example of the arrangement with the electronic cooling-and-heating unit with reference to FIGS. 7 and 8. The printing press of FIGS. 7 and 8 has the same arrangement as that of the aforementioned embodiment except for the use of a cooling-and-heating unit 30. The cooling-and-heating unit 30 includes an electronic cooling-and-heating element (a peltiert element) and is formed integral with the lid 12 in proximity to a top of the lid 12, thus constituting a part of the lid 12. For example, when the temperature of the plate surface is to be lowered by cooling the plate-replacement space 11, air is fed into the cooling-and-heating unit 30 within the plate-replacement space 11 by a cooling fan (not shown) in the direction of arrow 31, and cooled air is fed onto the plate cylinder 1 through the air outlets 23 in the direction of arrow 32. At the same time, dehumidified water extracted from air is discharged via a drain pipe 33 and heat is released to the outside of the lid 12 by a heat-releasing fan (not shown) in the directions of arrows 34 and 35. The heating and cooling are achieved by changing the direction of electric current sent from a controller 36, in which the controller 36 controls electric current flow on the basis of the output from the sensor 25.

The cooling-and-heating unit 30 provided in the plate-surface temperature control device A can make the control device A compact in size, and is advantageous particularly for the arrangement where the cooling-and-heating unit 30 is provided on the lid 12.

It is possible to design the plate-surface temperature control device A so as to be able to be automatically actuated and stopped in association with the opening and closing actions of the lid 12, whether the cooling-and-heating unit 30 is use or not.

Figure 9:
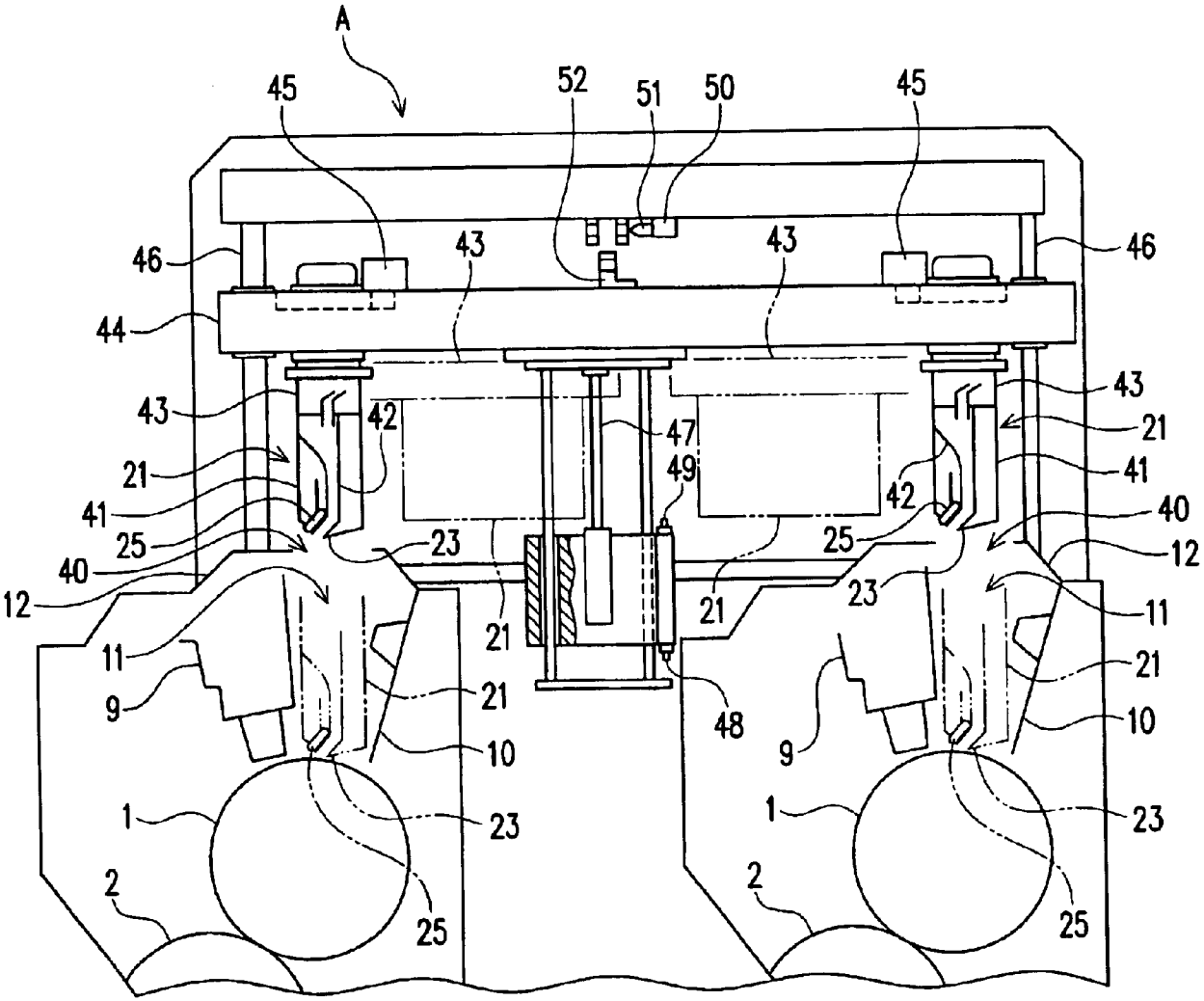
FIG. 9 is a front elevational view of an essential portion of the printing press with the temperature control unit according to yet another embodiment of the present invention.
Figure 10:
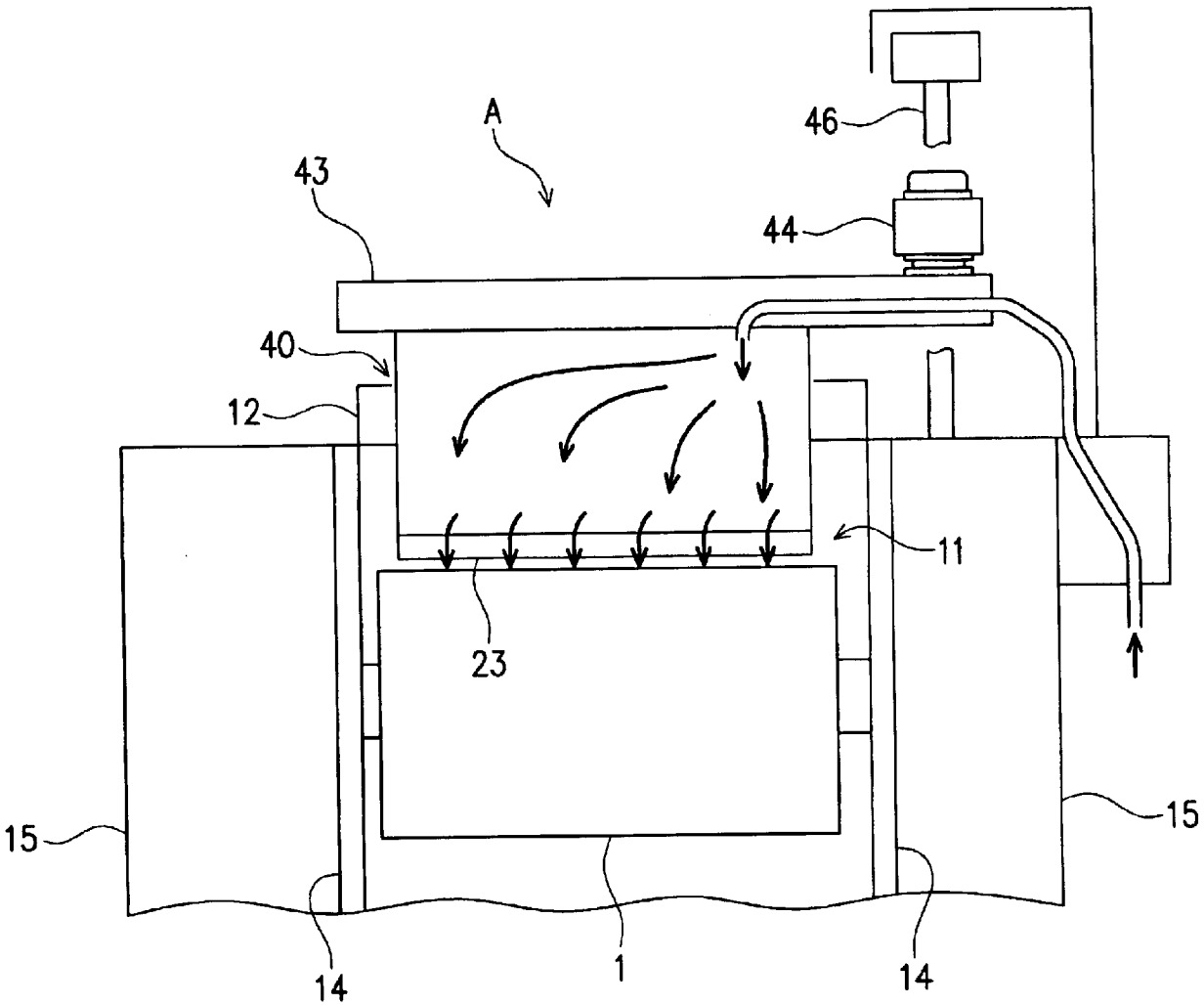
FIG. 10 is a side elevational view of the essential portion of the printing press of FIG. 9.

While the above description was made by taking for example the case where the air outlets 23 are shifted between the temperature control position and the retracted position, the arrangement allowing the air outlets 23 to change their positions are not necessarily limited to this arrangement. Accordingly, various arrangements may be employed. For example, as illustrated in FIGS. 9 and 10, a passing hole 40 may be formed in the lid 12, through which the air outlets 23 can pass into and out of the plate-replacement space 11.

The cylinder alignment or the like in the printing press is the same as that of FIG. 1. Each nozzle 21 having the air outlet 23 at its lower end includes a nozzle body 41 through which air passes and a nozzle cover 42 for covering over the nozzle body 41, and is entirely formed into an elongated, hollow rectangular parallelepiped shape. Accordingly, the passing hole 40 of the lid 12 is sized to allow the nozzle 21 to pass therethrough, and is designed to be substantially closed by the nozzle 21 when in a temperature control mode with the nozzle 21 inserted into the hole. The temperature sensor 25 is located adjacent to the air outlet 23 within the nozzle cover 42. In other words, the sensor 25 is positioned at the lower end of the nozzle 21 so as to be moved along with the nozzle 21.

An arm member 43 having a rectangular hollow column shape is secured to the upper end of the nozzle 21 in each plate cylinder 1 so that the nozzle 21 is held in a suspending state as extending downward from the arm member 43 in a substantially vertical direction. The nozzle 21 is provided for each plate cylinder 1, and a movable beam 44 is provided between both the plate cylinders 2 to pivotally movably support proximal ends of the arms 43. The arm members 43 each are pivotally movable by about 90 degrees or smaller by a rotary actuator 45. With this arrangement, both the arm members 43 as well as both the nozzles 21 are pivotally moved in a double-door like manner, that is, in such a manner as to be pivotally moved to the opposite sides, thereby coming into an operational position, and pivotally moved to the middle therebetween to meet to each other, thereby coming into a retracted position as illustrated in chain double-dashed line in FIG. 9. In this retracted position, the nozzles 21 are located close to each other. Air is fed from the rear side of the printing press through the arm members 43 into the nozzles 21.

The movable beam 44 is supported by a pair of support posts 46 located on the lateral opposite sides and actuated by an air cylinder 47 mounted substantially at the center of the movable beam 44 so as to be vertically movable along the support posts 46. The vertical motion of the movable beam 44 is limited by limiters 48, 49 so as to be stopped at the same height for each of the respective operations. When the movable beam has been moved to an upper stop position (a transit position), an air cylinder 50 as a locking means brings its rod 51 into an "OUT" position so that the rod 51 extends through a blanket 52 secured on an upper surface of the movable beam 44, thereby locking the movable beam 44 to its position.

According to the thus arranged plate-surface temperature control device A, both the nozzles 21 are linearly and vertically moved until the air outlets 23 each reach the outside of the lid 12. Then, when the air outlets 23 each are positioned outside of the lid 12, the nozzles 21 are pivotally moved in a horizontal plane around the vertical axis by about 90 degrees in the double-door like manner. That is, both the air outlets 23 are linearly and vertically moved so as to be moved towards and away from the plate cylinders 1 (First Motion) until the air outlets 23 each reach the transit position at which each reaches the outside of the lid 23, that is, until the upward motion of the movable beam 44 is limited by the upper limiter 49, and pivotally moved in the double-door like manner by about 90 degrees in a horizontal plane (Second Motion) during the air outlets 23 each travel from the transit position just above the lid 12 to the retracted position. According to the pivotal motion of both the nozzles 21 in the double-door like manner, when the plate-surface temperature control device A is to be used, the nozzles 21, which have been pivotally moved rearward and held in the retracted position, are pulled forward from the retracted position by electric motion. When out of use, they may be held rearward in the retracted position. With the nozzles 21 held rearward in the retracted position, a space above the lid 12 is opened to the outside so that the nozzles 21 are unlikely to interfere the plate-replacement work, achieving smooth replacement in a lid opened state. It is to be noted that this pivotal motion can be manually made.

When the plate-surface temperature control device A is to be held in a temperature control mode, the nozzles 21 are moved parallel to each other from the transit positions in a substantially vertical direction into the plate-replacement space 11, thereby allowing the air outlets 23 to be positioned at temperature control positions in proximity to the plate cylinders 1. The temperature control positions are illustrated in chain double-dashed line in FIG. 9 while being illustrated in solid line in FIG. 10. The arrangement allowing the air outlets 23 to be linearly moved towards and away from the plate cylinders 1 can allow the air outlets 23 to be easily moved closer to the plate cylinders 1 even if the plate-replacement space 11 is relatively small, and hence achieve the temperature control for the plate surface in more precise and easy manner.

The above linear motion of the air outlets 23 towards and away from the plate cylinders 1 are not necessarily achieved throughout the entire traveling distance, as far as they are linearly moved at least until the air outlets 23 reach the outside of the lids 12.

The cylinder alignment or the like can be modified according to needs and circumstances. Among various fields to which the printing press of the present invention is applied, a remarkable effect of the present invention is demonstrated in waterless printing, printing using UV curing ink and the like.

Thus, the printing press with the temperature control unit for the plate surface, which can control the temperature of the plate surface while efficiently utilizing the plate-replacement space, contributes to efficient utilization of the space around each plate cylinder and is suitable for decrease in size of the printing press, as well as achieving the precise temperature control.

This specification is by no means intended to restrict the present invention to the preferred embodiments set forth therein. Various modifications to the printing press with the temperature control unit for the plate cylinder, as described herein, may be made by those skilled in the art without departing from the spirit and scope of the present invention as defined in the appended claims.

What is claimed is:

1. A printing press with a temperature control unit for controlling the temperature of a surface of a printing plate mounted on a plate cylinder by feeding air onto said plate cylinder;

a plate-replacement space being provided in a certain region around said plate cylinder for replacement of a printing plate mounted on said plate cylinder with a new one introduced from the outside of the printing press;

said temperature control unit being designed to be selectively shifted between a temperature control mode and a space opening mode;

said temperature control mode enabling air to be fed through said plate-replacement space onto said plate cylinder; and said space opening mode making said plate-replacement space open to the outside of the printing press enabling the replacement of a printing plate;

a lid capable of being opened and closed is provided over said plate-replacement space enabling a printing plate mounted on said plate cylinder to be replaced with a new one through said plate-replacement space during said lid is opened;

said temperature control unit has an air outlet formed integral with an inner side of said lid; and said air outlet is designed to be selectively shifted between a temperature control position enabling air to be fed through said plate-replacement space onto said plate cylinder and a retracted position making said plate-replacement space open to the outside of the printing press upon opening and closing actions of said lid.

2. A printing press with a temperature control unit for controlling the temperature of a surface of a printing plate mounted on a plate cylinder by feeding air onto said plate cylinder;

a plate-replacement source being provided in a certain region around said plate cylinder for replacement of a printing plate mounted on said plate cylinder with a new one introduced from the outside of the printing press;

said temperature control unit being designed to be selectively shifted between a temperature control mode and a space opening mode;

said temperature control mode enabling air to be fed through said plate-replacement space onto said plate cylinder; and said space opening mode making said plate-replacement space open to the outside of the printing press enabling the replacement of a printing plate;

a lid capable of being opened and closed is provided over said plate-replacement space enabling a printing plate mounted on said plate cylinder to be replaced with a new one through said plate-replacement space during said lid is opened;

said lid having a passing hole, through which an air outlet passes into and out of said plate-replacement space, thereby allowing said air outlet to be held at a temperature control position on the inner side of the lid when in said temperature control mode of said temperature control unit, and to be held at a retracted position on the outer side of said lid when in said space opening mode of said temperature control unit; and said air outlet is linearly moved toward and away from said plate cylinder at least a distance from said temperature control position to a position at which said air outlet having passed through said passing hole reaches the outside of said passing hole in the entire travel distance between the temperature control position and the retracted position.

3. A printing press with a temperature control unit for controlling the temperature of a surface of a printing plate mounted on a plate cylinder by feeding air onto said plate cylinder;

a plate-replacement space being provided in a certain region around said plate cylinder for replacement of a printing plate mounted on said plate cylinder with a new one introduced from the outside of the printing press;

said temperature control unit being designed to be selectively shifted between a temperature control mode and a space opening mode;

said temperature control mode enabling air to be fed through said plate-replacement space onto said plate cylinder; and said space opening mode making said plate-replacement space open to the outside of the printing press enabling the replacement of a printing plate;

a lid capable of being opened and closed is provided over said plate-replacement space enabling a printing plate mounted on said plate cylinder to be replaced with a new one through said plate-replacement space during said lid is opened;

said lid having a passing hole, through which an air outlet passes into and out of said plate-replacement space, thereby allowing said air outlet to be held at a temperature control position on the inner side of the lid when in said temperature control mode of said temperature control unit, and to be held at a retracted position on the outer side of said lid when in said space opening mode of said temperature control unit; and said air outlet is linearly moved toward and away from said plate cylinder at least a distance from said temperature control position to a position at which said air outlet having passed through said passing hole reaches the outside of said passing hole in the entire travel distance between the temperature control position and the retracted position;

said plate-replacement space and said lid are located above said plate cylinder;

said air outlet takes a first motion and second motion during said air outlet moves between said temperature adjustment position and said retracted position;

said first motion is vertical linear motion, said motion being taken between a transit position above said lid and said temperature control position;

said second motion is a pivotal motion in a horizontal plane around a vertical axis, said motion being taken between said transit position and said retracted position;

said printing press included two plate cylinders located parallel to each other in a horizontal plane and said air outlet is provided for each of said plate cylinders; and said air outlets of said plate cylinders are pivotally moved in a double-door like manner in said second motion.

* * * * *